US009920985B2

(12) United States Patent
Mock et al.

(10) Patent No.: US 9,920,985 B2
(45) Date of Patent: Mar. 20, 2018

(54) LIQUEFIED NATURAL GAS PLANT WITH ETHYLENE INDEPENDENT HEAVIES RECOVERY SYSTEM

(75) Inventors: Jon M. Mock, Houston, TX (US); Megan V. Evans, Houston, TX (US); Attilio J. Praderio, Humble, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 507 days.

(21) Appl. No.: 13/570,690

(22) Filed: Aug. 9, 2012

(65) Prior Publication Data

US 2013/0199238 A1 Aug. 8, 2013

Related U.S. Application Data

(60) Provisional application No. 61/522,049, filed on Aug. 10, 2011.

(51) Int. Cl.
*F25J 1/00* (2006.01)
*F25J 1/02* (2006.01)
*F25J 3/02* (2006.01)

(52) U.S. Cl.
CPC ..... *F25J 1/0022* (2013.01); *F25J 1/004* (2013.01); *F25J 1/0035* (2013.01); *F25J 1/0052* (2013.01);
(Continued)

(58) Field of Classification Search
CPC ..... F25J 1/0022; F25J 1/0052; F25J 1/0055; F25J 1/0207; F25J 1/0208; F25J 1/0238; F25J 1/0242; F25J 2200/78; F25J 2220/64; F25J 2270/60; F25J 2230/60; F25J 1/0237; F25J 1/0239; F25J 1/0241
(Continued)

(56) References Cited

U.S. PATENT DOCUMENTS 3,929,438 A * 12/1975 Harper et al. ..... 62/612
3,956,415 A * 5/1976 Cummings et al. ..... 62/630
(Continued)

FOREIGN PATENT DOCUMENTS

WO 1998031973 7/1997
WO 1997036139 10/1997
(Continued)

OTHER PUBLICATIONS

International Search Report (PCT Article 18 and Rules 43 and 44). PCT/US2012/050147. Form PCT/ISA/210 (dated Jul. 2009). dated Oct. 11, 2012.

*Primary Examiner* — Jianying Atkisson
*Assistant Examiner* — Jose O Class-Quinones
(74) *Attorney, Agent, or Firm* — ConocoPhillips Company

(57) ABSTRACT

A process and apparatus for liquefying natural gas includes a heavies recovery system. In another aspect, a liquefied natural gas (LNG) facility may employ an ethylene independent heavies recovery system. The recovery system may thus operate relying only on fluid input from upstream of an ethylene refrigeration cycle. A heavies-depleted stream recovered from a liquid withdrawn from a heavies removal column in the heavies recovery system may combine at a location downstream of the heavies removal column with an overhead withdrawn from the heavies removal column for further cooling of such combined stream into liquefied natural gas product.

4 Claims, 1 Drawing Sheet

(52) U.S. Cl.
CPC ..... *F25J 1/0082* (2013.01); *F25J 1/0085* (2013.01); *F25J 1/021* (2013.01); *F25J 1/0231* (2013.01); *F25J 3/0209* (2013.01); *F25J 3/0233* (2013.01); *F25J 3/0242* (2013.01); *F25J 2200/02* (2013.01); *F25J 2200/78* (2013.01); *F25J 2205/02* (2013.01); *F25J 2205/04* (2013.01); *F25J 2230/20* (2013.01); *F25J 2230/30* (2013.01); *F25J 2245/02* (2013.01); *F25J 2260/20* (2013.01)

(58) Field of Classification Search
USPC ..... 62/611–613, 618, 620–621, 623, 630, 62/912, 932
See application file for complete search history.

(56) References Cited

U.S. PATENT DOCUMENTS

| | | | | |
|---|---|---|---|---|
| 4,012,212 | A * | 3/1977 | Kniel | 62/621 |
| 4,061,481 | A * | 12/1977 | Campbell | F25J 3/0209 62/621 |
| 4,195,979 | A * | 4/1980 | Martin | 62/613 |
| 4,430,103 | A * | 2/1984 | Gray et al. | 62/620 |
| 4,445,916 | A | 5/1984 | Newton | |
| 5,325,673 | A | 4/1994 | Durr et al. | |
| 5,600,969 | A | 2/1997 | Low | |
| 5,669,238 | A | 9/1997 | Devers | |
| 5,737,940 | A | 4/1998 | Yao et al. | |
| 5,983,665 | A | 11/1999 | Howard et al. | |
| 6,112,549 | A | 9/2000 | Yao et al. | |
| 6,289,692 | B1 | 9/2001 | Houser et al. | |
| 6,401,486 | B1 * | 6/2002 | Lee et al. | 62/630 |
| 6,453,698 | B2 | 9/2002 | Jain et al. | |
| 6,560,989 | B1 | 5/2003 | Roberts et al. | |
| 6,742,358 | B2 | 6/2004 | Wilkinson et al. | |
| 7,010,937 | B2 | 3/2006 | Wilkinson et al. | |
| 7,210,311 | B2 | 5/2007 | Wilkinson et al. | |
| 7,237,407 | B2 | 7/2007 | Paradowski | |
| 7,310,971 | B2 | 12/2007 | Eaton et al. | |
| 2001/0052241 | A1 | 12/2001 | Jain et al. | |
| 2003/0005722 | A1 | 7/2003 | Wilkinson et al. | |
| 2004/0187520 | A1 | 9/2004 | Wilkinson et al. | |
| 2004/0244415 | A1 | 12/2004 | Paradowski | |
| 2005/0268649 | A1 | 12/2005 | Wilkinson et al. | |
| 2005/0279132 | A1 * | 12/2005 | Eaton | F25J 1/021 62/613 |
| 2005/0284176 | A1 | 12/2005 | Eaton et al. | |
| 2006/0086139 | A1 | 4/2006 | Eaton et al. | |
| 2007/0012072 | A1 | 1/2007 | Qualls et al. | |
| 2007/0056318 | A1 | 3/2007 | Ransbarger et al. | |
| 2008/0022716 | A1 | 1/2008 | Eaton et al. | |
| 2008/0028790 | A1 | 2/2008 | Wilkinson et al. | |
| 2008/0115532 | A1 | 5/2008 | Jager | |
| 2009/0126401 | A1 | 5/2009 | Mock et al. | |
| 2009/0301132 | A1 * | 12/2009 | Evans | F25J 1/0022 62/631 |
| 2010/0175424 | A1 | 7/2010 | Walther | |
| 2011/0094263 | A1 | 4/2011 | Wilding et al. | |

FOREIGN PATENT DOCUMENTS

| | | |
|---|---|---|
| WO | 2002101307 | 12/2002 |
| WO | 2006047098 | 5/2006 |
| WO | 2006061400 | 6/2006 |
| WO | 2006071261 | 7/2006 |
| WO | 2007008638 | 1/2007 |
| WO | 2007032981 | 3/2007 |
| WO | 2008022998 | 2/2008 |
| WO | 2009064952 | 5/2009 |

* cited by examiner

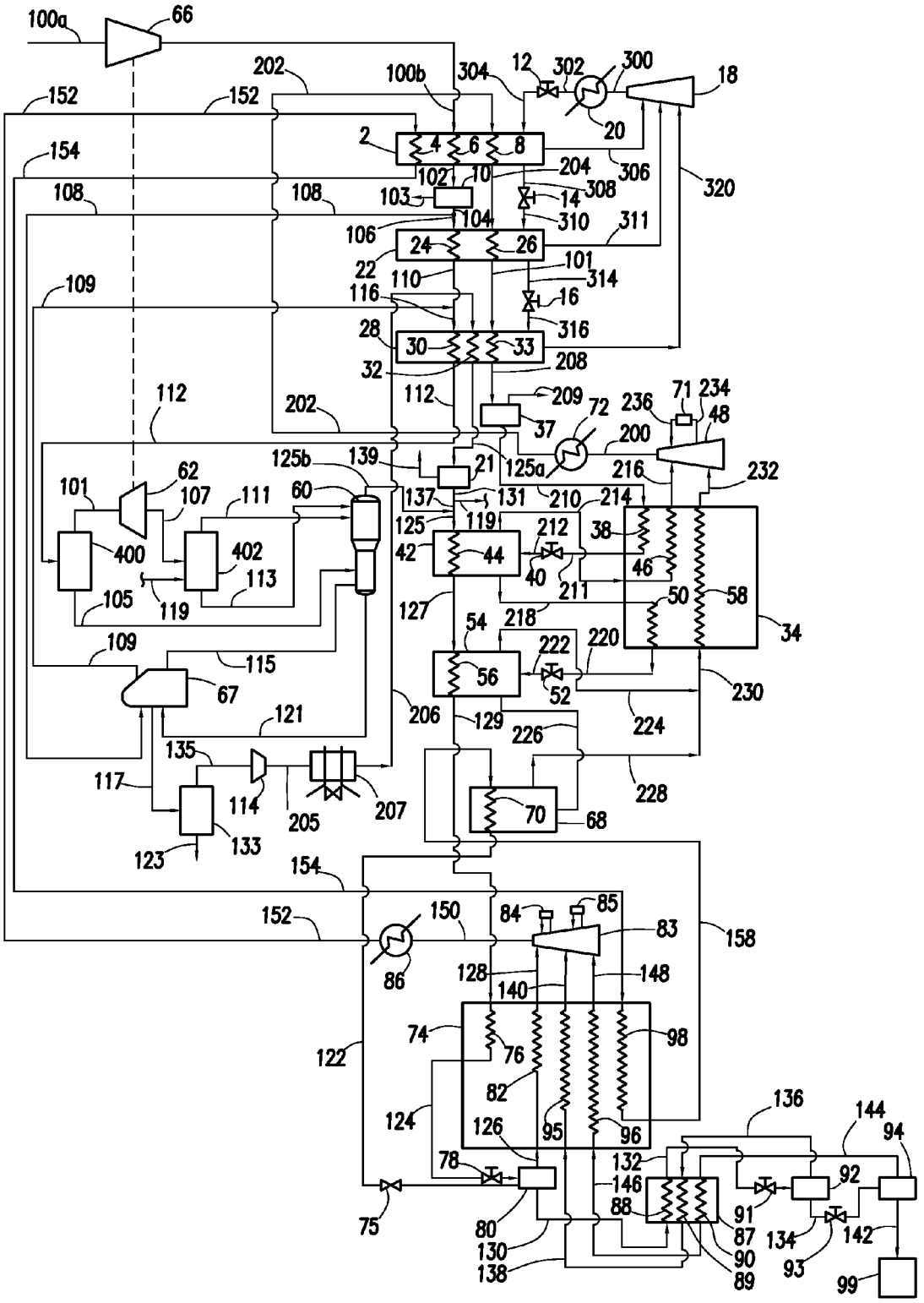
100a
66
202
100b
304
12
302
300
18
152
152
2
4
6
8
20
154
102
10
204
306
320
108
108
103
14
308
104
310
311
106
24
26
22
110
101
314
109
116
16
316
28
30
33
32
208
112
202
112
209
72
236
71
234
48
37
200
125b
139
21
125a
216
232
101
62
107
111
60
137
131
210
214
125
119
212
38
42
44
40
46
400
402
113
211
105
119
50
58
127
218
34
54
222
220
109
115
56
52
230
67
206
129
226
224
121
135
117
114
205
207
228
70
68
133
123
154
152
150
84
85
83
158
86
128
148
140
74
98
76
122
82
136
144
124
126
95
96
94
78
132
92
146
88
91
75
80
87
134
142
130
90
93
138
89
99

LIQUEFIED NATURAL GAS PLANT WITH ETHYLENE INDEPENDENT HEAVIES RECOVERY SYSTEM

CROSS-REFERENCE TO RELATED APPLICATIONS

This application is a non-provisional application which claims benefit under 35 USC § 119(e) to U.S. provisional application Ser. No. 61/522,049 filed Aug. 10, 2011, entitled "Liquefied Natural Gas Plant with Ethylene Independent Heavies Recovery System," which is hereby incorporated by reference.

FIELD OF THE INVENTION

This invention relates to processes and apparatuses for liquefying natural gas, and more particularly, to a liquefied natural gas (LNG) facility employing an ethylene-independent heavies recovery system.

BACKGROUND OF THE INVENTION

Natural gas is frequently transported by pipeline from a supply source to a distant market. It is oftentimes desirable to operate the pipeline under a substantially constant and high load factor. However, at times the deliverability or capacity of the pipeline may exceed demand while at other times the demand may exceed the deliverability or capacity of the pipeline. In order to shave off peaks when demand exceeds supply or the valleys when supply exceeds demand, it is desirable to store excess gas in such a manner that it can be delivered during periods when demand exceeds supply. Such practice allows future demand peaks to be met with stored natural gas. One practical means for doing this is to convert natural gas into a liquefied state such as liquefied natural gas ("LNG") via a liquefaction process for storage during periods of low demand and then vaporize the liquefied natural gas as demand requires. Liquefaction of natural gas can be especially useful when a pipeline is either not available or impractical for transporting natural gas from a supply source that is separated by a great distance to a candidate market. Moreover, transport of natural gas by ocean-going vessels is generally not practical because appreciable pressurization is required to significantly reduce the specific volume of the gas. Such pressurization requires the use of more expensive storage containers.

An example of a liquefaction technique is cryogenic liquefaction which can reduce the volume of the natural gas up to about 600-fold. Cryogenic liquefaction can convert natural gas into liquefied natural gas that can be stored and transported at near atmospheric pressures. Cryogenic liquefaction process can involve cooling natural gas down to about −240° F. to about −260° F. while the liquefied natural gas is at near-atmospheric vapor pressure. Natural gas is liquefied by sequentially passing the natural gas at an elevated pressure through a plurality of cooling stages whereupon the natural gas is cooled to successively lower temperatures until liquefaction temperature is reached. Cooling may be accomplished by indirect heat exchange with one or more refrigerants such as propane, propylene, ethane, ethylene, methane, nitrogen, carbon dioxide, or combination of the preceding refrigerants (i.e., mixed refrigerant systems). Some liquefaction techniques employ an open methane cycle for the final refrigeration cycle where a pressurized LNG-bearing stream is flashed. The flash vapors (i.e., the flash gas stream(s)) are subsequently used as cooling agents, recompressed, cooled, combined with processed natural gas feed stream. The combined stream may then be liquefied to produce a pressurized LNG-bearing stream.

One technical challenge that can arise during liquefaction of natural gas is the removal of heavy hydrocarbons. While natural gas is primarily comprised of methane, it may also contain heavy hydrocarbon components. These heavy hydrocarbon components should be removed from the natural gas prior to liquefaction since heavy hydrocarbon components can freeze and/or foul downstream heat exchangers. To avoid these potential issues, LNG facilities can include one or more heavies removal columns for removing heavy hydrocarbon components. However, conventional heavies removal columns often require operation within very narrow ranges of temperature, pressure, and feed composition in order to efficiently remove heavy hydrocarbon components. In some cases, a variation of a few degrees in feed temperature of a conventional heavies removal column can cause all or most of the fluid in the column to turn to liquid, which can result in major process upsets. Moreover, incorporation of heavies removal columns in a liquefaction system can increase power requirements of subsequent refrigeration systems (e.g., ethylene refrigeration system). In some cases, these power requirements can substantially limit operation of a liquefaction system. Thus, a need exists for a process and an apparatus employing a heavies removal column that can reduce the power requirements of subsequent refrigeration systems.

SUMMARY OF THE INVENTION

In an embodiment of the present invention, a method for liquefaction of natural gas includes: (a) cooling a portion of a natural gas feed stream to produce a cooled natural gas feed stream; (b) combining the cooled natural gas feed stream with a compressed reflux stream to form a combined natural gas stream; (c) separating the combined natural gas stream into a first lights stream and a first heavies stream; (d) expanding the first lights stream to form an expanded first lights stream; (e) introducing at least a portion of the first heavies stream and at least a portion of the expanded first lights stream into a heavies removal column to form a heavies-depleted stream and a heavies-rich stream; (f) separating at least a portion of the heavies-rich stream into a reflux stream and a heavier stream; and (g) compressing the reflux stream into a compressed reflux stream.

In another embodiment of the present invention, a method for liquefaction of natural gas, includes: (a) cooling a portion of a natural gas feed stream via indirect heat exchange with a first refrigerant to form a cooled natural gas feed stream; (b) separating the cooled natural gas feed stream into a first lights stream and a first heavies stream; (c) expanding the first lights stream into an expanded first lights stream; (d) separating the expanded first lights stream into a second lights stream and a second heavies stream; (e) introducing at least a portion of the first heavies stream, at least a portion of the second lights stream and at least a portion of the second heavies stream into a heavies removal column to form a heavies-depleted stream and a heavies-rich stream; (f) cooling at least a portion of the of the heavies depleted stream via indirect heat exchange with a second refrigerant; (g) separating at least a portion of the heavies-rich stream into a reflux stream and a heavier stream; and (h) compressing the reflux stream into a compressed reflux stream.

In a further embodiment of the present invention, an apparatus for liquefaction of natural gas includes: (a) a first heat exchanger in a first refrigeration cycle for cooling a portion of the natural gas stream via indirect heat exchanger with a first refrigerant; (b) a first separator for separating the first cooled natural gas stream into a first lights stream and a first heavies stream; (c) a first expander for expanding the first lights stream into an expanded first lights stream; (d) a heavies removal column positioned downstream of the first heat exchanger, wherein the heavies removal column separates the expanded first lights stream, the first heavies stream and a second cooled liquid stream into a first heavies-depleted stream and a first heavies-rich stream; (e) a separation vessel for separating the first heated liquid stream into a second heavies-depleted stream and a second heavies-rich stream; (f) a second compressor for compressing the second heavies-depleted stream into a compressed second heavies-depleted stream; and (g) a second heat exchanger in the first refrigeration cycle for cooling a combined stream via indirect heat exchange with the compressed second heavies-depleted stream.

BRIEF DESCRIPTION OF THE DRAWINGS

The invention, together with further advantages thereof, may best be understood by reference to the following description taken in conjunction with the accompanying drawing in which:

FIG. 1 is a simplified flow diagram of a cascaded refrigeration process for LNG production in accordance with an embodiment of the present disclosure.

DETAILED DESCRIPTION OF THE INVENTION

Reference will now be made in detail to embodiments of the present invention, one or more examples of which are illustrated in the accompanying drawing. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

A cascaded refrigeration system uses one or more refrigerants to transfer heat energy from a natural gas stream to the refrigerant(s) and ultimately release the heat energy to its environment. This refrigeration system may be thought of as a heat pump that removes heat energy from the natural gas stream as the stream is progressively cooled to lower and lower temperatures. The design of a cascaded refrigeration system and process often focuses on the tradeoffs between thermodynamic efficiencies and capital costs. Thermodynamically, a heat transfer process between a cool object and a warm object becomes increasingly irreversible as the temperature gradient between the two objects increases. Conversely, thermodynamic irreversibility is reduced as the temperature gradient decreases. Tradeoffs become important considerations because, among other things, reducing the temperature gradient to a thermodynamically efficient level may require significant increases in heat transfer area, major modifications to various process equipment used in a refrigeration system, and proper adjustment of flow rates through the refrigeration system. In particular, proper adjustment of flow rates may affect both flow rates and temperatures (e.g., approach and outlet) in order to obtain desired heating/cooling duty.

As used herein, the term "open-cycle cascaded refrigeration process" refers to a cascaded refrigeration process comprising one open refrigeration cycle and at least one closed refrigeration cycle in which the boiling point of the refrigerant/cooling agent employed in the open cycle is lower than the boiling point of the refrigerating agent employed in the closed cycle. In this process, a portion of the cooling duty used to condense the compressed open-cycle refrigerant/cooling agent may be provided by one or more of the closed cycles. As used herein, a natural gas stream is any stream principally comprised of methane which originates in major portion from a natural gas feed stream, such feed stream containing, for example, at least 85 mole percent methane, with the remaining balance include components such as, but not limited to, ethane, higher hydrocarbons, nitrogen, and carbon dioxide. Other minor contaminants may include, but are not limited to, mercury, hydrogen sulfide, and mercaptan.

According to one or more embodiments of the present invention, a predominately methane stream is employed as the refrigerant/cooling agent in the open cycle. This predominantly methane stream can originate from processed natural gas feed stream and can include compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One efficient and effective method of liquefying natural gas involves utilizing an optimized cascade-type operation in conjunction with expansion-type cooling. Such a liquefaction method involves cascade-type cooling of a natural gas stream at elevated pressures (e.g., about 650 psia) by sequentially cooling the natural gas stream via passage through, for example, a multistage propane cycle, a multistage ethane or ethylene cycle, and an open-end methane cycle that utilizes a portion of the feed gas as a source of methane. The method may also include a multistage expansion cycle to further cool and reduce the pressure of the natural gas stream to near-atmospheric pressure. During cooling cycles, the refrigerant with the highest boiling point is utilized first, followed by utilization of refrigerant with next highest boiling point and so forth.

In general, the liquefaction process (i.e., LNG process) may employ one or more refrigerants to extract heat from the natural gas, which is then subsequently rejected into the environment. In some embodiments, the LNG process employs a cascade-type refrigeration process that uses a plurality of multi-stage cooling cycles, each cycle employing a different refrigerant composition, to sequentially cool the natural gas stream to lower and lower temperatures. In other embodiments, the LNG process may utilize mixed refrigerant(s) or refrigerant mixtures to cool the natural gas stream.

Various pre-treatment steps can remove undesirable components from natural gas feed streams. Such undesirable components may include, but are not limited to, acid gases, mercaptan, mercury, moisture, and the like. In some embodiments, the composition of the natural gas feed stream may vary significantly. These pre-treatment steps may be separate steps located either upstream of the cooling cycles or located downstream of one of the early stages of cooling in the initial cycle. As used herein, the terms "upstream" and "downstream" describe the relative positions of various components of a natural gas liquefaction plant along the flow path of natural gas through the plant. In particular, acid gases and to a lesser extent mercaptan can be removed by a chemical reaction process employing an aqueous amine-bearing solution. This treatment step is generally performed upstream of the cooling stages in the initial cycle. A major portion of the water can be removed as a liquid by a two-phase gas-liquid separation that follows gas compression and cooling upstream of the initial cooling cycle and also downstream of the first cooling stage in the initial cooling cycle. Mercury can be removed by mercury sorbent beds. Residual amounts of water and acid gases can be removed by the use of properly selected sorbent beds such as regenerable molecular sieves.

The pre-treated natural gas feed stream may be delivered to the liquefaction system at an elevated pressure or may be compressed to an elevated pressure. In some embodiments, the pressure is greater than about 500 psia or preferably between about 500 psia to about 3000 psia. In some embodiments, about the pressure is between about 500 psia to about 1000 psia or preferably between about 600 psia to about 800 psia. The feed stream temperature is typically near ambient to slightly above ambient. In some embodiments, the temperature may be between about 60° F. to about 150° F. As previously noted, the natural gas feed stream may be cooled by an LNG process involving a plurality of multistage cycles, each cycle containing a different refrigerant. The overall cooling efficiency for a cycle typically improves as the number of stages increases. However, this increase in efficiency is often counter-balanced by a corresponding increase in net capital cost from, for example, an increase in complexity of the LNG system.

In some embodiments, the feed gas is passed through a number of refrigeration cycles, each cycle comprising a number of stages (at least two, preferably two to four, and more preferably two or three). The first closed refrigeration cycle utilizes a first refrigerant with a relatively high boiling point. Such a refrigerant may include a hydrocarbon such as, but not limited to, propane, propylene, and mixtures thereof. In some embodiments, a hydrocarbon is the major portion of the refrigerant. For example, the refrigerant may include at least about 75 mole percent propane, at least 90 mole percent propane, or essentially propane.

After the first refrigeration stage, the resulting processed feed gas flows through a number of stages (at least two, preferably two to four, and more preferably two or three) in a second closed refrigeration cycle that includes a refrigerant with an intermediate boiling point. Suitable examples of the second refrigerant may include, but are not limited to, ethane, ethylene, and mixtures thereof. In some embodiments, the second refrigerant includes at least about 75 mole percent ethylene, at least 90 mole percent ethylene, or essentially ethylene. Each cooling stage of the refrigeration cycle may include a separate cooling zone. As previously noted, the processed natural gas feed stream may be combined with one or more recycle streams (i.e., compressed open methane cycle gas streams) at various locations in the second refrigeration cycle to produce a liquefaction stream. In the last stage of the second cooling cycle, the liquefaction stream is condensed (i.e., liquefied) in major portion, preferably in its entirety, to produce a pressurized LNG-bearing stream. Generally, the process pressure at this location is only slightly lower than the pressure of the pre-treated feed gas in the first stage of the first refrigeration cycle.

It may desirable for the natural gas feed stream to include certain levels of $C_2$+ (i.e., hydrocarbons containing at least two carbons) components such that $C_2$+ rich liquid will form in one or more of the cooling stages. This $C_2$+ rich liquid may be removed via gas-liquid separation means (e.g., gas-liquid separators). Generally, sequential cooling of the natural gas in each stage is controlled so as to remove as much of the $C_2$+ and higher molecular weight hydrocarbons as possible from the gas to produce a gas stream predominating in methane and a liquid stream containing significant amounts of ethane and heavier components.

In some embodiments, a number of gas/liquid separation means can be located at strategic locations downstream of the cooling zones for removal of liquids streams rich in $C_2$+ components. The exact locations and number of gas/liquid separation means will be dependant on a number of operating parameters. Examples of such parameters may include, but are not limited to, $C_2$+ composition of the natural gas feed stream, desired BTU content of the LNG product, value of the $C_2$+ components for other applications, and other factors routinely considered by those skilled in the art of LNG plant and gas plant operation. The $C_2$+ hydrocarbon stream(s) may be demethanized via a single stage flash or a fractionation column to produce a methane-rich stream. In the former case, the resulting methane-rich stream can be repressurized and recycled or used as fuel gas. In the latter case, the resulting methane-rich stream can be directly returned at pressure (i.e., not requiring additional compression to be combined with the liquefaction process) to the liquefaction process. The $C_2$+ hydrocarbon stream(s) or the demethanized $C_2$+ hydrocarbon stream may be used as fuel. In some embodiments, the streams may be further processed, such as by fractionation in one or more fractionation zones to produce individual streams rich in specific chemical constituents (e.g., $C_2$, $C_3$, $C_4$ and $C_5$+ hydrocarbons).

In one or more embodiments, the pressurized LNG-bearing stream undergoes further cooling by a third refrigeration cycle ("open methane cycle") in a main methane economizer containing flash gases (i.e., flash gas streams) generated from this third cycle and by sequential expansion of the pressurized LNG-bearing stream to near atmospheric pressure. The flash gases used as a refrigerant ("third refrigerant") in the third refrigeration cycle may include, but are not limited to, methane. In some embodiments, the third refrigerant comprises at least 75 mole percent methane, at least 90 mole percent methane, or essentially methane. During expansion of the pressurized LNG-bearing stream to near atmospheric pressure, the pressurized LNG-bearing stream is cooled via at least one, preferably two to four, and more preferably three expansions in which each expansion employs an expander as a means of reducing pressure. Suitable expanders may include, for example, Joule-Thomson expansion valves, hydraulic expanders, and the like. The expansion may be followed by a separation of the gas-liquid product using a separator. When a hydraulic expander is employed and properly operated, some of the benefits include greater efficiencies associated with the recovery of power, greater reduction in stream temperature, and production of less vapor during the flash expansion step. These benefits can off-set or exceed the higher capital and operating costs associated with the expander. In some embodiments, additional cooling of the pressurized LNG-bearing stream prior to flashing is made possible by first flashing a portion of this stream via one or more hydraulic expanders and then via indirect heat exchange means employing the flash gas stream to cool the remaining portion of the pressurized LNG-bearing stream prior to flashing. The warmed flash gas stream is then recycled via return to an appropriate location, based on temperature and pressure considerations, in the open methane cycle where it can be recompressed.

The liquefaction process described herein may use one of several types of cooling such as, but not limited to, indirect heat exchange, vaporization, and expansion or pressure reduction. As used herein, the term "indirect heat exchange" refers to a process in which a refrigerant cools a substance without making physical contact with the substance. Specific examples of indirect heat exchange means include, but are not limited to, a shell-and-tube heat exchanger, a core-in-kettle heat exchanger, and a brazed aluminum plate-fin heat exchanger. The physical state of refrigerant and substance to be cooled can vary depending on the demands of the liquefaction system and the type of heat exchanger chosen. For example, a shell-and-tube heat exchanger may be utilized where the refrigerant is in a liquid state and the substance is in a liquid or gaseous state. A shell-and-tube heat exchanger may also be utilized when either the refrigerant or substance undergoes a phase change and process conditions do not favor the use of other exchangers such as a core-in-kettle heat exchanger. Aluminum and aluminum alloys are often used as materials for the core of heat exchangers but may not be suitable for use under certain designated process conditions. For example, a plate-fin heat exchanger may be utilized where the refrigerant is in a gaseous state and the substance is in a liquid or gaseous state. Finally, a core-in-kettle heat exchanger may be utilized where the substance is liquid or gas and the refrigerant undergoes a phase change from a liquid state to a gaseous state during the heat exchange. Vaporization cooling refers to the cooling of a substance by the evaporation or vaporization of a portion of the substance with the system maintained at a constant pressure. During vaporization, a portion of the evaporated substance absorbs heat from the portion of the substance that remains in a liquid state and consequently, the liquid portion is cooled. Finally, expansion or pressure reduction cooling refers to cooling that occurs when the pressure of a gas, liquid or a two-phase system is lowered by passing through a pressure reduction means. In some embodiments, the expansion means may be a Joule-Thomson expansion valve or a hydraulic/gas expander. Because expanders recover work energy from the expansion process, lower process stream temperatures are possible upon expansion.

Referring to FIG. 1, a natural gas feed stream is fed into inlet compressor 66 downstream of a dehydration unit and a mercury removal unit via conduit 100*a* to produce a compressed natural gas feed stream. The compressed natural gas feed stream is then fed into a high-stage propane chiller 2 via conduit 100*b* to produce a cooled natural gas feed stream. A number of other conduits (e.g., 152, 202, 304) also lead into the high-stage propane chiller 2. In the illustrated embodiment, gaseous methane refrigerant that is part of the closed loop propane system is introduced into the high-stage propane chiller 2 via conduit 152 while compressed ethylene refrigerant is introduced via conduit 202. Streams 100*b*, 152, and 202 are cooled by indirect heat exchange means 6, 4, and 8 respectively to produce cooled gas streams that flow through conduits 102, 154, and 204 respectively. The indirect heat exchange occurs between the aforementioned streams and propane that has been processed as follows.

Gaseous propane that is part of the closed loop propane system may be compressed in a multistage (e.g., a three-stage) compressor 18 driven by a gas turbine driver (not illustrated). Each stage of the compressor may be separate units, mechanically coupled to one another to be driven by a single driver or combination of drivers. The resulting compressed propane may be passed through conduit 300 to a cooler 20 where it is cooled and liquefied. While pressure and temperature of the liquefied propane refrigerant prior to flashing can vary, representative values may be about 100° F. and about 190 psia. The stream from cooler 20 is passed through conduit 302 to a pressure reduction means, illustrated as expansion valve 12. Here the pressure of the liquefied propane is reduced, thereby evaporating or flashing a portion of the liquefied propane. The resulting two-phase product then flows through conduit 304 into a high-stage propane chiller 2.

After the indirect heat exchange has taken place, the propane gas can exit the high-stage propane chiller 2 and return to compressor 18 via conduit 306. This propane gas is fed into the high-stage inlet port of compressor 18. The remaining liquid propane from the indirect heat exchange can exit the high-stage propane chiller 2 via conduit 308. The pressure of the liquid propane may be further reduced by passage through a pressure reduction means, illustrated as expansion valve 14, whereupon at least a portion of the liquefied propane is flashed. The resulting two-phase propane stream is then fed via conduit 310 into an intermediate-stage propane chiller 22 where it can serve as a coolant.

The cooled natural gas feed stream described earlier can exit the chiller high-stage 2 through conduit 102 into separation equipment 10 that can separate a stream into gas and liquid phases. The liquid phase can be rich in $C_3$+ components and is removed via conduit 103. The gaseous phase exits the separation equipment 10 via conduit 104 that splits into two separate conduits (106 and 108). The stream in conduit 106 continues into the intermediate-stage propane chiller 22. Compressed ethylene refrigerant stream is also introduced into the intermediate-stage propane chiller 22 (via conduit 204). The streams that flows through conduits 106 and 204 are cooled via indirect heat exchange means 24 and 26 respectively to produce cooled gas streams in conduits 110 and 101. Once the propane refrigerant has cooled the streams, at least a portion of the propane evaporates. This evaporated portion is separated and passed through conduit 311 into the intermediate-stage inlet of compressor 18. The remaining liquid portion of the propane refrigerant from the intermediate-stage propane chiller 22 is removed via conduit 314 and flashed across a pressure reduction means, illustrated as expansion valve 16. The flashed propane is then fed into a low-stage propane chiller/condenser 28 via conduit 316.

In the embodiment illustrated in FIG. 1, the natural gas stream flows from intermediate-stage propane chiller 22 via conduit 110 and combines with a chilled natural gas stream from conduit 109 to form a combined natural gas stream. A portion of the combined natural gas stream then flows into the low-stage propane chiller 28 via conduit 116. Also flowing into the low-stage propane chiller 28 is a portion of a second heavies-depleted stream via conduit 206 and the ethylene refrigerant stream via conduit 101. The combined natural gas stream, the second heavies-depleted stream, and the ethylene refrigerant stream are cooled by indirect heat exchange means 30, 32, and 33 respectively to produce cooled gas streams 112, 125*a*, and 208 respectively. The indirect heat exchange means produce vaporized propane which is removed from low-stage propane chiller 28 and returned to the low-stage inlet of compressor 18 via conduit 320. In some embodiments, the propane refrigeration cycle utilizes a high-stage chiller and a low-stage chiller.

Still referring to FIG. 1, a portion of the cooled natural gas stream exiting the low-stage propane chiller 28 is introduced into separator 400 via conduit 112. The separator 400 separates the cooled natural gas stream into a first heavies stream and a first lights stream. The separator 400 typically operates at high pressures. The first heavies stream from separator 400 is sent to the middle of the heavies removal column 60 via conduit 105. The first lights stream from separator 400 is fed into expander 62 (which drives the inlet compressor 66). Upon expansion, the first lights stream is introduced to separator 402 via conduit 107. A portion of the stream that exits surge drum 21 may also be introduced into separator 402 via conduit 119. The streams in separator 402 produce a second lights stream and a second heavies stream. Typically, separator 402 operates at relatively low pressures. In some embodiments, separator 400 operates at a higher pressure than separator 402. The second lights stream exiting separator 402 is introduced to the heavies removal column 60 via conduit 111. Likewise, the second heavies stream exiting separator 402 is introduced to the heavies removal column 60 via conduit 113. Locating heavies removal column 60 immediately downstream of low-stage propane chiller 28 widens the acceptable operating parameters of heavies removal column 60 compared to known systems. The heavies removal column 60 produces a heavies-depleted vapor stream that exits column 60 via conduit 125*b* and a heavies-rich liquid stream that exits column 60 via conduit 121.

The heavies-rich liquid stream exiting the heavies removal column 60 via conduit 121 is fed into reboiler 67. Heat exchange takes place in reboiler 67 between the heavies rich liquid stream introduced via conduit 121 and at least a portion of the stream exiting separation vessel 10 via conduit 108. The heavies-rich stream exiting the heavies removal column 60 via conduit 121 serves to cool down the portion of the natural gas feed stream from conduit 108 in reboiler 67. The resulting chilled natural feed gas stream from conduit 109 is combined with a portion of the cooled natural gas stream in conduit 110 to produce a combined natural gas stream in conduit 116. Stream in conduit 115 is a hot light vapor stream that exits from the reboiler 67 and acts as a stripping gas in the heavies removal column 60. Stream in conduit 117 is the heavy liquid product from the reboiler 67 which is sent to column 133 (a depropanizer) for further processing and stabilization. Stream in conduit 117 exiting reboiler 67 is introduced to vessel 133 for flashing or fractionating. A second heavies-rich stream is produced via conduit 123 and a second heavies-depleted vapor stream is produced via conduit 135. The second heavies-depleted stream is fed into compressor 114 so that it can be chilled and condensed to form the reflux for the heavies removal column. The compressed second heavies-depleted stream flows to cooler 207 via conduit 205. This chilled second heavies-depleted stream is fed to low-stage propane chiller 28 via conduit 206 where it is condensed via indirect heat exchange means 32, removed via conduit 125*a* and fed to surge drum 21. The liquid is removed from surge drum 21 via conduit 131. A portion of the stream exiting surge drum 21 in conduit 131 is introduced into separator 402 via conduit 119. The remaining portion of the stream exiting surge drum 21 in conduit 131 is combined with the heavies-depleted vapor stream exiting heavies removal column 60 in conduit 125*b* to form combined stream 125.

Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The liquid stream exiting surge drum 37 in conduit 210 then flows into an ethylene economizer 34 where it is cooled via indirect heat exchange means 38, removed via conduit 211, and passed through a pressure reduction means, illustrated as an expansion valve 40, whereupon the refrigerant is flashed to a specified temperature and pressure, and fed to high-stage ethylene chiller 42 via conduit 212. Vapor is removed from chiller 42 via conduit 214 and routed to ethylene economizer 34 where the vapor functions as a coolant via indirect heat exchange means 46. The ethylene vapor is then removed from ethylene economizer 34 via conduit 216 and fed to the high-stage inlet of ethylene compressor 48. The ethylene refrigerant that is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into an intermediate-stage ethylene chiller 54 via conduit 222.

The heavies-depleted vapor stream exiting heavies removal column 60 via conduit 125*b* is combined with at least a portion of the cooled stream exiting low stage chiller 28 via conduit 137 to form combined stream 125. The combined stream undergoes further cooling in high-stage ethylene chiller 42 via indirect heat exchange means 44. After cooling the methane-rich stream is removed from high-stage ethylene chiller 42 via conduit 127. This stream is then condensed in part via cooling provided by indirect heat exchange means 56 in low-stage ethylene chiller 54, thereby producing a two-phase stream that is directed to a main methane economizer 74 via conduit 129, where the stream is further cooled by indirect heat exchange means/heat exchanger pass 76.

As previously noted, the gas in conduit 154 is fed to main methane economizer 74 where the stream is cooled via indirect heat exchange means 98. The resulting cooled compressed methane recycle or refrigerant stream in conduit 158 is further cooled in the low-stage ethylene chiller 68. In low-stage ethylene chiller 68, this stream is cooled and condensed via indirect heat exchange means 70 with the liquid effluent from valve 52 that is routed to low-stage ethylene chiller 68 via conduit 226. The condensed methane-rich product from low-stage condenser 68 is produced via conduit 122. The vapor from low-stage ethylene chiller 54, withdrawn via conduit 224, and the stream from low-stage ethylene chiller 68, withdrawn via conduit 228, are combined and routed via conduit 230 to ethylene economizer 34 wherein the vapors function as a coolant via indirect heat exchange means 58. The stream is then routed via conduit 232 from ethylene economizer 34 to the low-stage inlet of ethylene compressor 48.

As shown in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module where the modules are mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

It may be preferable that the main methane economizer 74 includes a plurality of heat exchanger passes that provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. The pressure of the stream in conduit 124 is then reduced by a pressure reduction means, illustrated as expansion valve 78 that evaporates or flashes a portion of the liquid stream thereby generating a two-phase stream. The pressure of the stream exiting low-stage ethylene chiller 68 via conduit 122 is reduced by a pressure reduction means, illustrated as expansion valve 75, which evaporates or flashes a portion of the liquid stream thereby generating a two-phase stream. The two-phase stream from expansion valve 78 then passes through high-stage methane flash drum 80 along with the two-phase stream from expansion valve 75 where they are separated into a flash gas stream discharged through conduit 126 and a liquid phase stream (i.e., pressurized LNG-bearing stream) discharged through conduit 130. The flash gas stream is then transferred to main methane economizer 74 via conduit 126 where the stream functions as a coolant in heat exchanger pass 82 and aids in the cooling of the stream in heat exchanger passes 76 and 98. Thus, the predominantly methane stream in heat exchanger pass 82 is warmed, at least in part, by indirect heat exchange with the predominantly methane stream in heat exchanger pass 76. The warmed stream exits heat exchanger pass 82 and methane economizer 74 via conduit 128. It is preferred for the temperature of the warmed predominantly methane stream exiting heat exchanger pass 82 via conduit 128 to be at least about 10° F. greater than the temperature of the stream in conduit 124, and more preferably at least about 25° F. greater than the temperature of the stream in conduit 124. The temperature of the stream exiting heat exchanger pass 82 via conduit 128 is preferably warmer than about −50° F., more preferably warmer than about 0° F., still more preferably warmer than about 25° F., and most preferably in the range of from about 40° F. to about 100° F.

The liquid-phase stream exiting high-stage flash drum 80 via conduit 130 is passed through a second methane economizer 87 where the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and vaporize a second portion thereof. This two-phase stream is passed to an intermediate-stage methane flash drum 92 where the stream is separated into a gas phase passing through conduit 136 and a liquid phase passing through conduit 134. The gas phase flows through conduit 136 to second methane economizer 87 where the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140 and is conducted to the intermediate-stage inlet of methane compressor 83.

The liquid phase stream exiting intermediate-stage flash drum 92 via conduit 134 is further reduced in pressure by passage through a pressure reduction means, illustrated as an expansion valve 93. Again, a portion of the liquefied natural gas is evaporated or flashed. The two-phase stream from expansion valve 93 is passed to a final or low-stage flash drum 94. flash drum 94, a vapor phase is separated and passes through conduit 144 to the second methane economizer 87. Here the vapor functions as a coolant via indirect heat exchange means 90, exits second methane economizer 87 via conduit 146 that is connected to the first methane economizer 74 where the vapor functions as a coolant via heat exchanger pass 96. The warmed vapor stream from heat exchanger pass 96 exits main methane economizer 74 via conduit 148 and is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

As shown in FIG. 1, the high, intermediate, and low stages of compressor 83 are combined as single unit. While this may be preferred in some embodiments, each stage may exist as a separate unit, each unit mechanically coupled to each other so that the units may be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduit 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and cooled in the low-stage ethylene chiller 68.

In one or more embodiment of the present invention, the LNG production systems illustrated in FIG. 1 is simulated on a computer using conventional process simulation software. Examples of suitable simulation software include HYSYS™ from Hyprotech, Aspen Plus® from Aspen Technology, Inc., and PRO/II® from Simulation Sciences Inc.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for liquefaction of natural gas comprising:

cooling a portion of a natural gas feed stream in a first propane refrigeration stage to produce a cooled natural gas feed stream;

splitting the cooled natural gas feed stream into first and second portions upstream of a second propane refrigeration stage, wherein the first portion of the cooled natural gas feed stream is cooled in the second propane refrigeration stage prior to combining upstream of a third propane refrigeration stage the first and second portions of the cooled natural gas feed stream to form a combined natural gas stream upon the second portion of the cooled natural gas feed stream being cooled by a heavies-rich stream;

separating the combined natural gas stream cooled in the third propane refrigeration stage into a first lights stream and a first heavies stream;

expanding the first lights stream to form an expanded first lights stream;

separating the expanded first lights stream into a second lights stream and a second heavies stream;

introducing at least a portion of the first heavies stream, at least a portion of the second heavies stream and at least a portion of the second lights stream into a heavies removal column to form a first heavies-depleted stream and the heavies-rich stream;

separating at least a portion of the heavies-rich stream into a second heavies-depleted stream and a heavier stream;

compressing the second heavies-depleted stream into a compressed second heavies-depleted stream; and combining downstream of the heavies removal column the first heavies-depleted stream and at least part of the second heavies-depleted stream for further cooling into liquefied natural gas product, wherein the first and second heavies-depleted streams are combined upstream of an initial stage chiller of an ethylene refrigeration cycle providing at least part of the further cooling into the liquefied natural gas product.

2. The method of claim 1, wherein the liquefaction is carried out in a multi-stage cascade-type liquefied natural gas facility.

3. The method of claim 1, further comprising cooling the second heavies-depleted stream in the third propane refrigeration stage prior to being combined with the first heavies-depleted stream upstream of the ethylene refrigeration cycle providing at least part of the further cooling into the liquefied natural gas product.

4. The method of claim 1, wherein the heavies removal column relies only on fluid input from upstream of the ethylene refrigeration cycle.

* * * * *